US005671720A

United States Patent [19]

Uchikawa

[11] Patent Number: 5,671,720

[45] Date of Patent: Sep. 30, 1997

[54] APPARATUS AND METHOD FOR CONTROLLING AIR-FUEL RATIO OF AN INTERNAL COMBUSTION ENGINE

[75] Inventor: Akira Uchikawa, Atsugi, Japan

[73] Assignee: Unisia Jecs Corporation, Kanagawa-ken, Japan

[21] Appl. No.: 700,971

[22] Filed: Aug. 21, 1996

[30] Foreign Application Priority Data

Aug. 30, 1995 [JP] Japan ..... 7-221506

[51] Int. Cl.[6] ..... F02D 41/00

[52] U.S. Cl. ..... 123/676

[58] Field of Search ..... 123/676, 478, 123/480, 492, 571, 679, 674; 364/431.05; 73/117.3

[56] References Cited

U.S. PATENT DOCUMENTS

| | | | |
|---|---|---|---|
| 4,452,207 | 6/1984 | Moore, Jr. | 123/676 |
| 5,239,971 | 8/1993 | Uchinami | 123/571 |
| 5,278,762 | 1/1994 | Kawamura | 364/431.05 |
| 5,391,284 | 2/1995 | Hotzel | 123/676 |
| 5,427,083 | 6/1995 | Ahern | 123/676 |

FOREIGN PATENT DOCUMENTS

| | | | |
|---|---|---|---|
| 60-240840 | 11/1985 | Japan | 123/676 |

*Primary Examiner*—Raymond A. Nelli

*Attorney, Agent, or Firm*—Lowe, Price, LeBlanc & Becker

[57] ABSTRACT

An air-fuel ratio feedback correction coefficient for correcting a fuel supply quantity to an engine is proportional-plus-integral controlled based on an output from an oxygen sensor for detecting oxygen concentration in the exhaust gases. When the oxygen sensor is in an inactive condition, deviation of an air-fuel ratio control point in the air-fuel ratio feedback control is detected, and an operating quantity in the proportional-plus-integral control is corrected so as to reduce the detected deviation.

20 Claims, 7 Drawing Sheets

APPARATUS AND METHOD FOR CONTROLLING AIR-FUEL RATIO OF AN INTERNAL COMBUSTION ENGINE

1. FIELD OF THE INVENTION

The present invention relates to an apparatus and method for controlling air-fuel ratio of an internal combustion engine, and in particular to technology for feedback controlling the air-fuel ratio of the engine intake mixture to a target air-fuel ratio.

2. DESCRIPTION OF THE RELATED ART

An example of an apparatus for controlling the air-fuel ratio of an internal combustion engine is disclosed for example in Japanese Unexamined Patent Publication No 60-240840.

This apparatus has a sensor for detecting the oxygen concentration in the exhaust gas which is closely related to the air-fuel ratio of the mixture. The sensor is provided in the form of an oxygen sensor which generates an electromotive force proportional to the ratio of the oxygen concentration in the exhaust gas to the oxygen concentration in the atmosphere. The detection signal from the oxygen sensor is compared with a slice level corresponding to the stoichiometric air-fuel ratio (target air-fuel ratio), to thereby judge if the actual air-fuel ratio is richer or leaner than the stoichiometric air-fuel ratio. An air-fuel ratio feedback correction coefficient is then proportional-plus-integral controlled based on the rich or lean judgment results, and the fuel injection quantity from the fuel injection valves corrected using the resultant air-fuel ratio feedback correction coefficient.

Under conditions such as during idle however when the exhaust gas temperature is low, the oxygen sensor becomes inactive with the temperature drop. If this occurs, then response to changes in the oxygen concentration in the exhaust gas suffers. Moreover, changes, such as a rise in the output at the time of lean air-fuel ratio, are produced in the output characteristics.

As a result, at the time of low exhaust gas temperature conditions, the air-fuel ratio becomes over rich or over lean during transition owing to the drop in control response. There is thus the possibility of continuous air-fuel ratio deviation under steady state conditions.

A heater may be provided for the oxygen sensor so as to keep the oxygen sensor active in spite of a drop in exhaust gas temperature, thereby avoiding the drop in air-fuel ratio controllability caused by the oxygen sensor becoming inactive. However there is then the problem of increased costs for fitting the heater.

SUMMARY OF THE INVENTION

In view of the above problems, it is an object of the present invention to be able to maintain air-fuel ratio control accuracy, even under inactive conditions of the oxygen sensor (air-fuel ratio sensor).

Moreover it is an object of the present invention to be able to maintain air-fuel ratio control response, even under inactive conditions of the oxygen sensor (air-fuel ratio sensor).

To achieve the above objectives, the apparatus and method for controlling an air-fuel ratio of an internal combustion engine according to the present invention includes; detecting a deviation of an air-fuel ratio control point in an air-fuel ratio feedback control from a target air-fuel ratio when an inactive condition of an air-fuel ratio sensor is detected, and correcting characteristics of the air-fuel ratio feedback control in a direction so as to reduce the deviation of the air-fuel ratio control point.

That is to say, when the air-fuel ratio sensor becomes inactive so that the output characteristics change causing the air-fuel ratio control point to deviate from the target air-fuel ratio, the air-fuel ratio feedback control characteristics are corrected, thus enabling control close to the target air-fuel ratio based on the output from the air-fuel ratio sensor in the inactive condition.

The construction may be such that a deviation of the air-fuel ratio control point is detected by comparing a rich time interval with a lean time interval during the air-fuel ratio feedback control.

When controlling so as to give an average target air-fuel ratio by switching between rich and lean conditions relative to the target air-fuel ratio, then when the rich time interval is longer than the lean time interval, the average air-fuel ratio deviates to rich side from the target air-fuel ratio while conversely, when the lean time interval is longer than the rich time interval, the average air-fuel ratio deviates to lean side from the target air-fuel ratio.

The inactive condition of the air-fuel ratio sensor may be detected based on exhaust gas temperature.

Since with exposure of the air-fuel ratio sensor element to the exhaust gases, the temperature of the element becomes approximately equal to that of the exhaust gases, then the active or inactive conditions of the air-fuel ratio sensor can be detected based on whether or not the exhaust gas temperature has attained the active temperature for the air-fuel ratio sensor.

Moreover, the inactive condition of the air-fuel ratio sensor may be detected based on engine load and engine rotational speed.

Since the exhaust gas temperature can be estimated from the engine load and the engine rotational speed, then the active or inactive condition of the air-fuel ratio sensor can be estimated based on the engine load and the engine rotational speed.

Furthermore the construction may be such that the inactive condition of the air-fuel ratio sensor is judged when engine cooling water temperature, engine rotational speed, engine load, intake air temperature, and exhaust gas temperature are respectively equal to or less than predetermined values.

By determining all of the cooling water temperature, the engine rotational speed, the engine load, the intake air temperature, and the exhaust gas temperature, which are all parameters correlated with the temperature of the air-fuel ratio sensor element, then the inactive condition of the air-fuel ratio sensor can be detected to a high accuracy. Here, the intake air temperature can be considered approximately equal to ambient air temperature.

With a construction wherein the actual air-fuel ratio is feedback controlled to a target air-fuel ratio by setting an air-fuel ratio feedback correction coefficient for correcting the fuel supply quantity to the engine, based on an output value from the air-fuel ratio sensor, then the construction may be such that deviation of the air-fuel ratio control point is reduced by correcting an operating quantity for the air-fuel ratio feedback correction coefficient.

For example, when the air-fuel ratio deviates from the target air-fuel ratio towards the lean side, the operating quantity during correction of the air-fuel ratio feedback correction coefficient towards the rich side is increased, or, the operating quantity during correction towards the lean side is reduced, to thereby correct the control characteristics in a direction to reduce the deviation of the air-fuel ratio control point.

Moreover, with a construction wherein the actual air-fuel ratio is feedback controlled to a target air-fuel ratio by proportional-plus-integral control of the air-fuel ratio feedback correction coefficient for correcting the fuel supply quantity to the engine, based on an output value from the air-fuel ratio sensor, then the construction may be such that deviation of the air-fuel ratio control point is reduced by correcting a delay time for the proportional control.

For example when the air-fuel ratio deviates from the target air-fuel ratio towards the lean side, then if the proportional control in the weaken direction, carried out after inversion from lean to rich is further delayed, then the rich control time is effectively increased. Hence the deviation of the air-fuel ratio control point can be reduced.

Preferably the characteristics of the air-fuel ratio feedback control are corrected so as to reduce the deviation of the air-fuel ratio control point as mentioned above, and also so that an actual control period approaches a reference period.

That is to say, when response drops due to the air-fuel ratio sensor being in the inactive condition, and the control period thus becomes longer than the reference period, then the control characteristics are corrected so as to shorten the control period. As a result, control to the target air-fuel ratio can be carried out with good response, even with the air-fuel ratio sensor in the inactive condition.

With the construction wherein the actual air-fuel ratio is feedback controlled to a target air-fuel ratio by proportional-plus-integral control of the air-fuel ratio feedback correction coefficient for correcting the fuel supply quantity to the engine, based on an output value from the air-fuel ratio sensor, then the control period may be corrected by correcting the integral portion in the integral control.

That is to say, when the response of the air-fuel ratio sensor drops, then the control response can be maintained by increasing the integral portion by the dropped portion.

For the air-fuel ratio sensor, a sensor which generates an electromotive force proportional to the ratio of the oxygen concentration in the atmosphere to the oxygen concentration in the exhaust gas, may be used.

Other objects and aspects of the present invention will become apparent from the following description of embodiments given in conjunction with the appended drawings.

DETAILED DESCRIPTION OF THE PREFERRED EMBODIMENT

Figure 1:
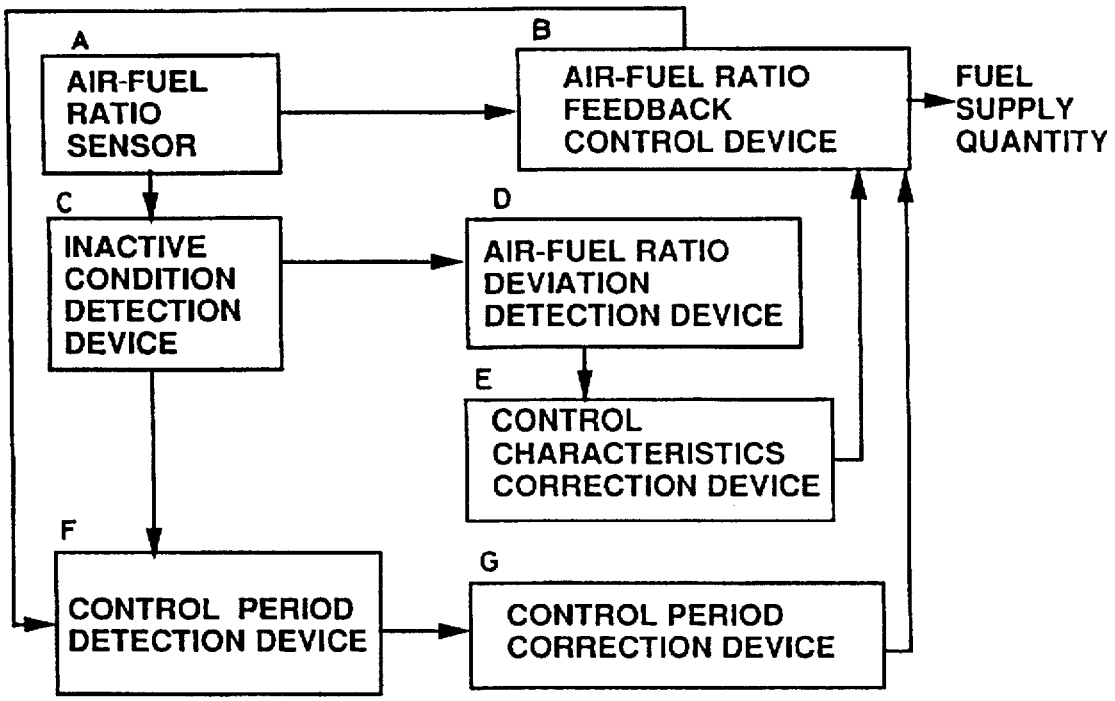
FIG. 1 is a block diagram showing a basic construction of an air-fuel ratio control apparatus according to the present invention.

FIG. 1 is a block diagram showing a basic construction of an air-fuel ratio control apparatus for an internal combustion engine according to the present invention.

In FIG. 1, an air-fuel ratio sensor A is one which is provided in the engine exhaust passage, being responsive to the concentration of specific constituents of the exhaust gas which change with the air-fuel ratio of the engine intake mixture, thus causing a change in the output value.

An air-fuel ratio feedback control device B feedback controls a fuel supply quantity to the engine so that an air-fuel ratio of the engine intake mixture approaches a target air-fuel ratio, based on an output value from the air-fuel ratio sensor A.

An inactive condition detection device C detects an inactive condition of the air-fuel ratio sensor A, while an air-fuel ratio deviation detection device D detects deviation from the target air-fuel ratio of an air-fuel ratio control point in the air-fuel ratio feedback control device B, when the inactive condition of the air-fuel ratio sensor A is detected by the inactive condition detection device C.

A control characteristics correction device E corrects the characteristics of the air-fuel ratio feedback control device B in a direction to reduce the deviation of the air-fuel ratio control point detected by the air-fuel ratio deviation detection device D.

A control period detection device F detects an air-fuel ratio control period in the air-fuel ratio feedback control device B, when the inactive condition of the air-fuel ratio sensor A is detected by the inactive condition detection device C.

A control period correction device G corrects the characteristics of the air-fuel ratio feedback control device B in a direction so that the control period detected by the control period detection device F approaches a reference period.

A basic embodiment of an air-fuel ratio control apparatus and an air-fuel ratio control method having the abovementioned basic construction will now be given with reference to the drawings.

Figure 2:
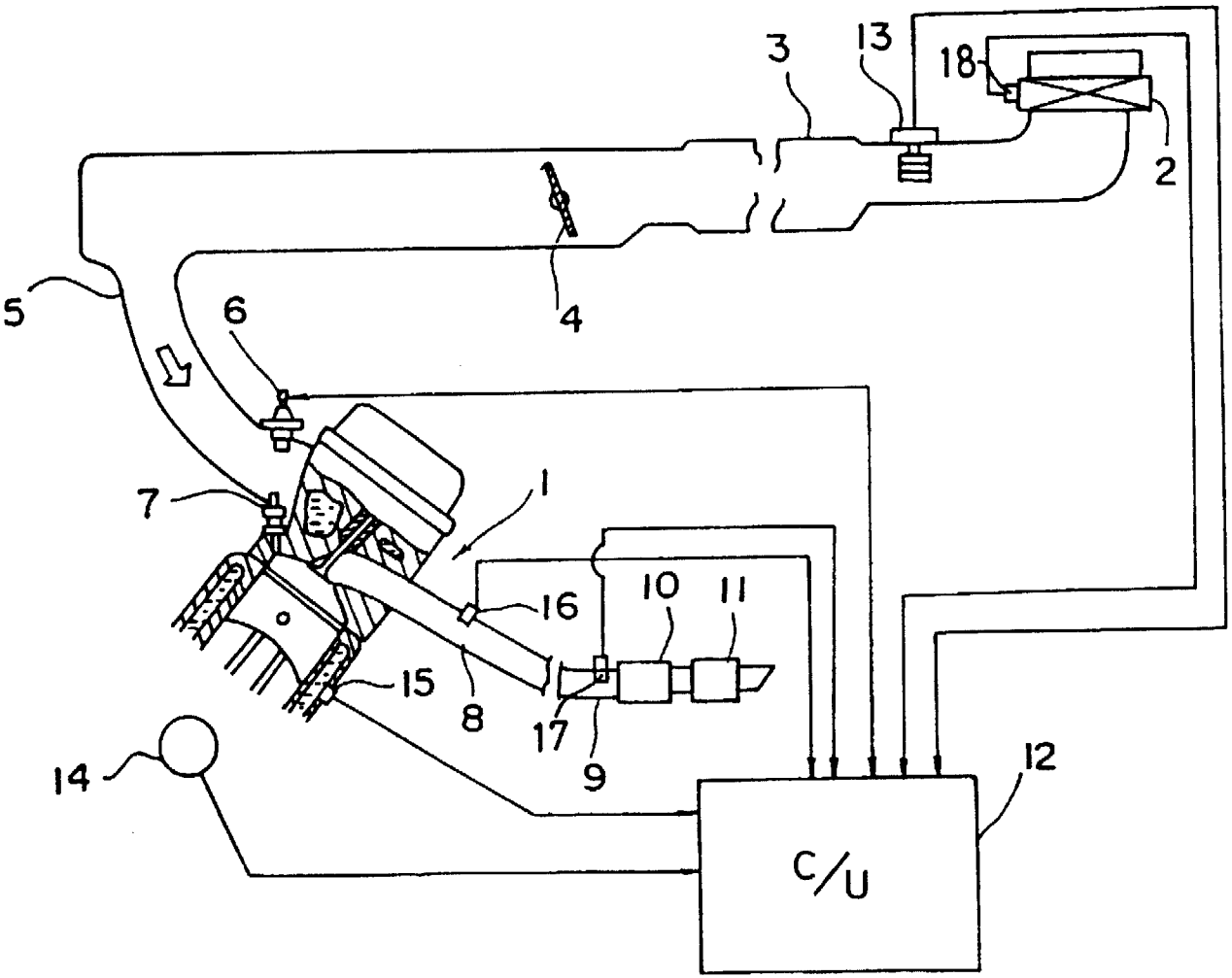
FIG. 2 is a schematic system diagram of an internal combustion engine in an embodiment.

Referring to the system structure of an internal combustion engine shown in FIG. 2, an internal combustion engine 1 draws in air from an air cleaner 2 by way of an intake duct 3, a throttle valve 4, and an intake manifold 5. Fuel injection valves 6 are provided for each of the cylinders, in respective branch portions of the intake manifold 5. The fuel injection valves 6 are electromagnetic type fuel injection valves which open with power to a solenoid and close with power shut-off. The injection valves 6 are electrically energized and driven open by a drive pulse signal provided by a control unit 12 (to be described later) so that fuel pressurized by a fuel pump (not shown), and controlled to a predetermined pressure by means of a pressure regulator (not shown), is injected into the engine 1.

Ignition plugs 7 are provided for each combustion chamber of the engine 1 for spark ignition of a mixture therein. Exhaust from the engine 1 is discharged by way of an exhaust manifold 8, an exhaust duct 9, a three-way catalytic converter 10, and a muffler 11.

The control unit 12 incorporates a microcomputer, having for example a CPU, ROM, RAM, AID converter and input/output interface. Input signals from the various sensors are received by the control unit 12; and computational processing carried out (as described later) to set the fuel injection quantity for the fuel injection valves 6, and control the opening of the fuel injection valves 6 in accordance with the set fuel injection quantity.

For the various sensors there is provided in the intake duct 3, an airflow meter 13, which outputs a signal corresponding to an intake air quantity Q of the engine 1.

Also provided is a crank angle sensor 14 which, in a case of a four cylinder engine, outputs a reference signal REF for each 180° crank angle, and a unit signal POS for each 1° or 2° crank angle. The period of the reference signals REF, or the number of unit signals POS within a predetermined period, is measured to compute the engine rotational speed Ne.

Moreover, a water temperature sensor 15 is provided for detecting the cooling water temperature Tw in the water jacket of the engine 1.

There is also an oxygen sensor 16 (air-fuel ratio sensor), provided at a junction portion of the exhaust manifold 8. The output from the oxygen sensor 16 changes due to influence from the oxygen concentration in the exhaust gases, thus enabling detection of the air-fuel ratio of the engine intake mixture. The oxygen sensor 16 is a concentration cell type sensor which generates an electromotive force corresponding to a ratio of the oxygen concentration in the exhaust to that in the atmosphere (refer to FIG. 8).

Also provided is an exhaust temperature sensor 17 for detecting the exhaust temperature, and an intake air temperature sensor 18 for detecting the intake air temperature.

The CPU of the microcomputer inside the control unit 12 computes a basic fuel injection quantity Tp based on the intake air quantity Q and the engine rotational speed Ne, and also proportional-plus-integral controls an air-fuel ratio feedback correction coefficient α so that the actual air-fuel ratio detected by the oxygen sensor 16 approaches the stoichiometric air-fuel ratio (target air-fuel ratio).

The basic fuel injection quantity Tp is then corrected using the air-fuel ratio feedback correction coefficient α, and a final fuel injection quantity Ti computed. A drive pulse signal with a pulse width corresponding to the fuel injection quantity Ti, is then output to the fuel injection valves 6 at a predetermined timing synchronized with the engine rotation.

Figure 6:
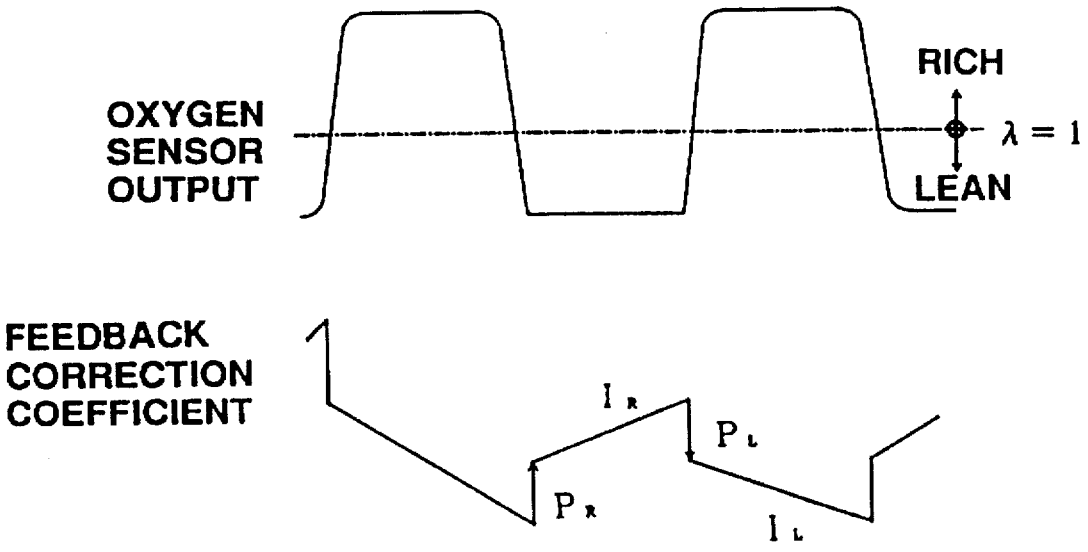
FIG. 6 is a time chart illustrating aspects of an air-fuel ratio feedback control.

The proportional-plus-integral control of the air-fuel ratio feedback correction coefficient α involves, as shown in FIG. 6, increase controlling the correction coefficient α by a predetermined proportional portion $P_R$ when the actual air-fuel ratio inverts from being richer than the target air-fuel ratio to being leaner, and then gradually increasing the correction coefficient α by a predetermined integral portion $I_R$. Then when the air-fuel ratio inverts to rich, decrease controlling the correction coefficient α by a predetermined proportional portion $P_L$, and then gradually decrease controlling the correction coefficient α by a predetermined integral portion $I_L$, until the air-fuel ratio inverts to lean (air-fuel ratio feedback control device).

Figure 3:
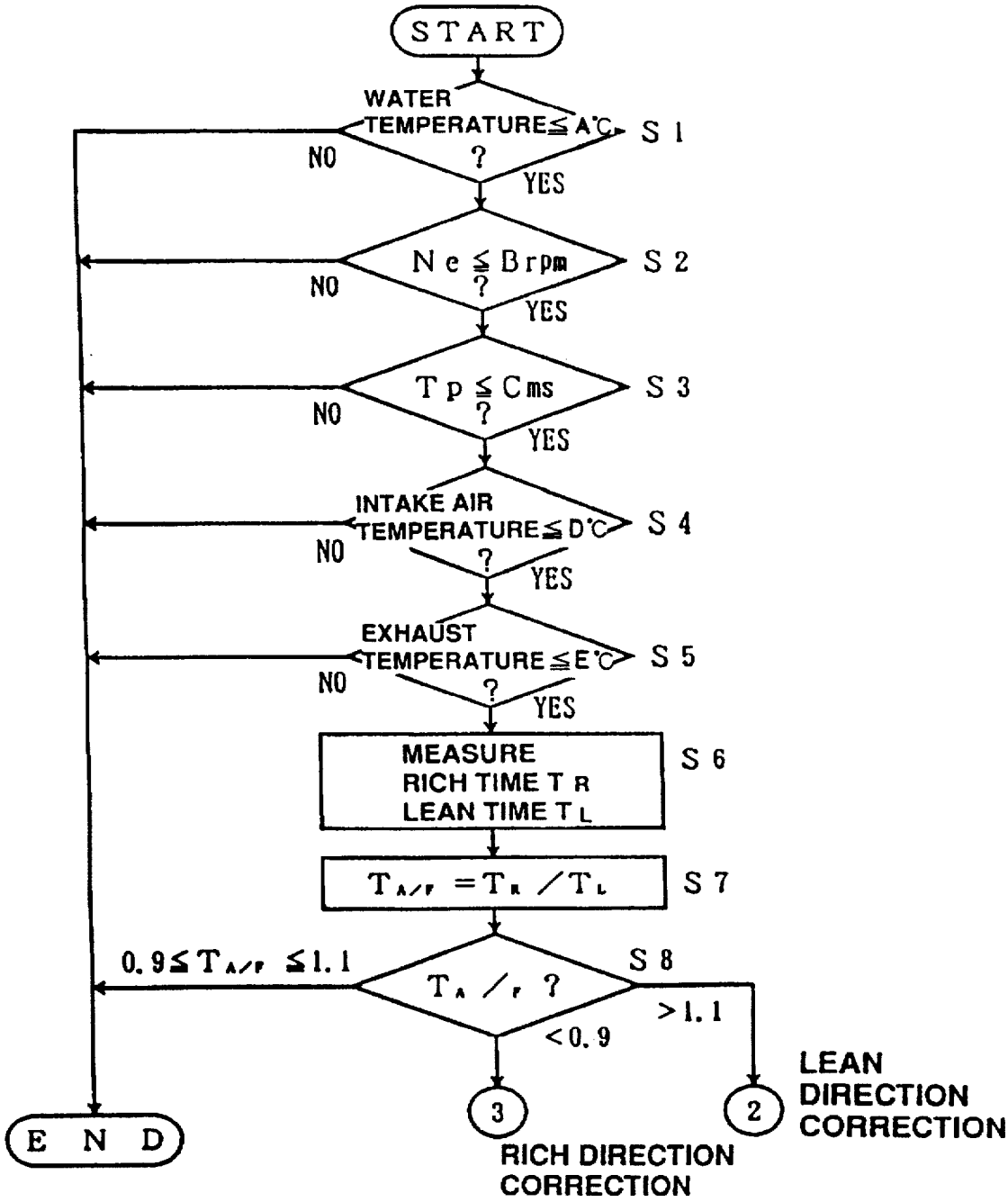
FIG. 3 is a flow chart showing a correction control routine for correcting deviation of an air-fuel ratio control point.
Figure 4:
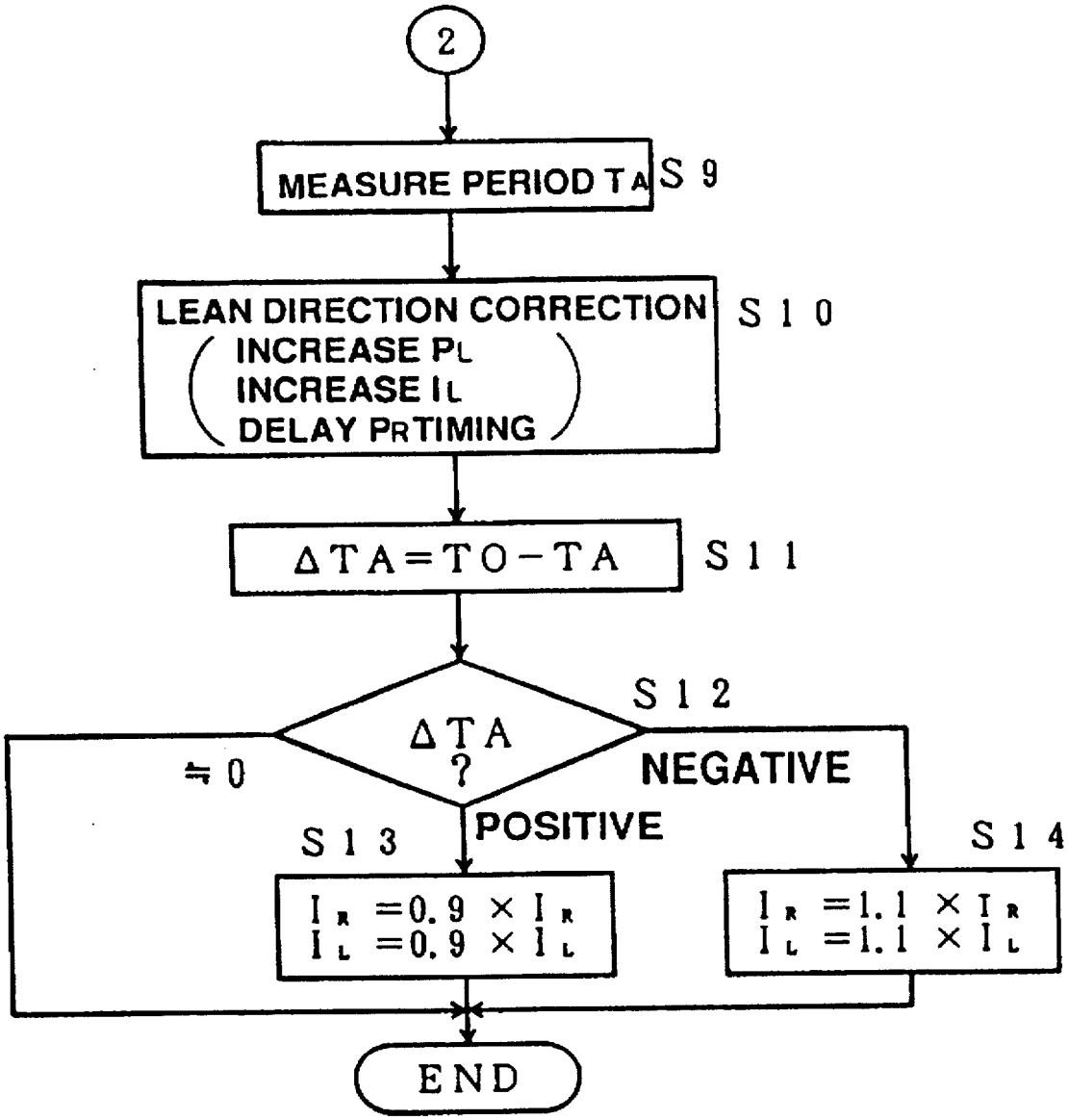
FIG. 4 is a flow chart showing a continuation of the correction control routine of FIG. 3.
Figure 5:
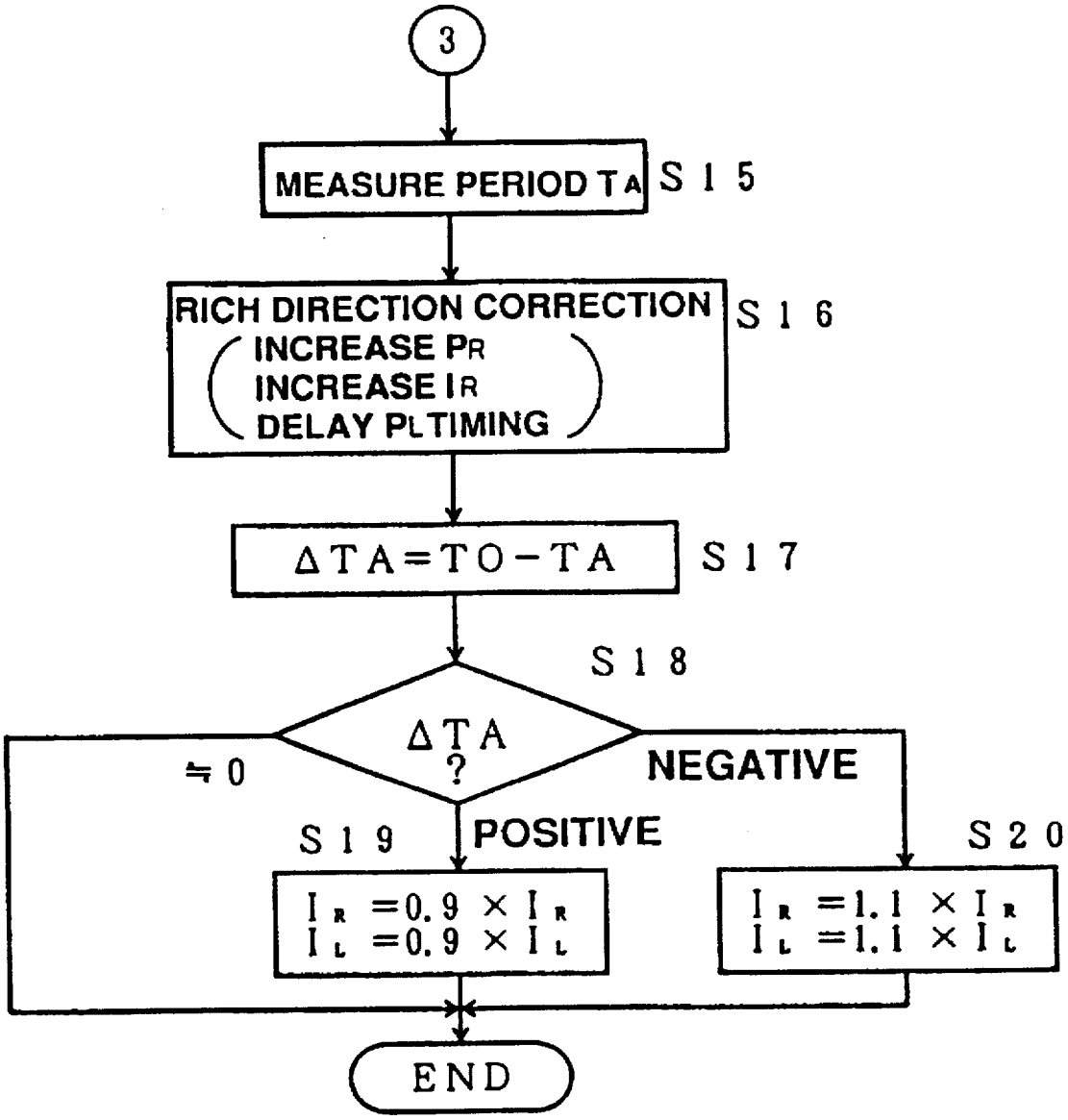
FIG. 5 is a flow chart showing another continuation of the correction control routine of FIG. 3.
Figure 8:
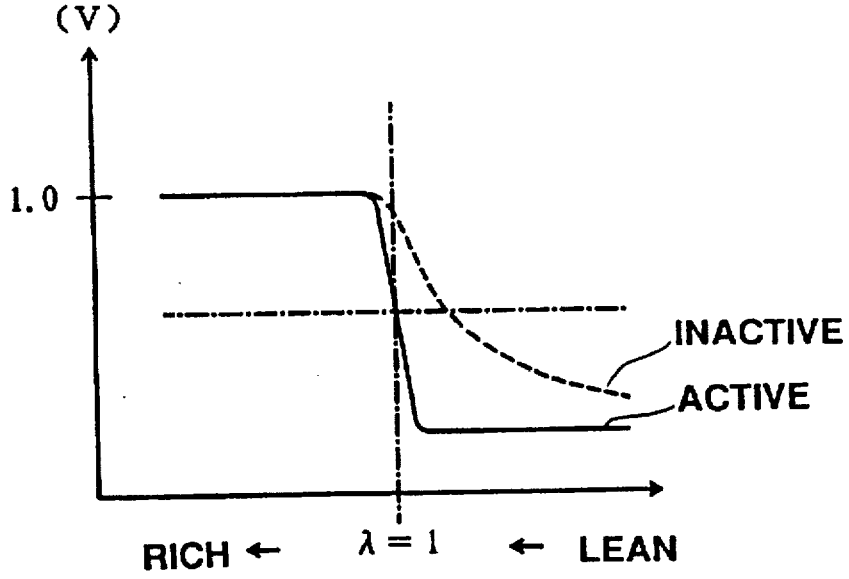
FIG. 8 is a graph showing changes in output characteristics of an oxygen sensor in an active condition.

Furthermore, the air-fuel ratio feedback control is corrected in accordance with the routine illustrated by the flow chart shown in FIG. 3 through FIG. 5, so that the air-fuel ratio control accuracy can be maintained, even when the oxygen sensor 16 becomes inactive so that the output characteristics change (refer to FIG. 8).

The functions of the inactive condition detection device C, the air-fuel ratio deviation detection device D, the control characteristics correction device E, the control period detection device F, and the control period correction device G are realized by software illustrated by the flow chart of FIG. 3 through FIG. 5, and stored in the control unit 12.

In the flow chart of FIG. 3 through FIG. 5, in step 1 ("step" being denoted by S in the figures) through step 5, detection of the inactive condition of the oxygen sensor 16 (refer to FIG. 8)is carried out.

That is to say, in step 1 through step 5, it is judged if all of the following conditions (a) through (e) have materialized. If so, the oxygen sensor 16 is judged to be in the inactive condition (the condition wherein the active temperature has not been reached), and control proceeds to step 6.

a. Cooling water temperature equal to or less than predetermined temperature A.

b. Engine rotational speed Ne equal to or less than predetermined speed B.

c. Basic fuel injection quantity Tp (representative of engine load) equal to or less than predetermined value C.

d. Intake air temperature equal to or less than predetermined temperature D.

e. Exhaust temperature equal to or less than predetermined temperature E.

In detecting the inactive condition of the oxygen sensor 16, a combination of conditions selected from amongst the above conditions (a) through (e) is acceptable. For example the construction may be such that with an engine not fitted with the exhaust temperature sensor 17 or the intake air temperature sensor 18, the inactive condition is judged when the conditions (a) through (c) have materialized. On the other hand, the construction may be such that when the exhaust temperature sensor 17 is fitted, then conditions (b) and (c) are not judged.

Figure 7:
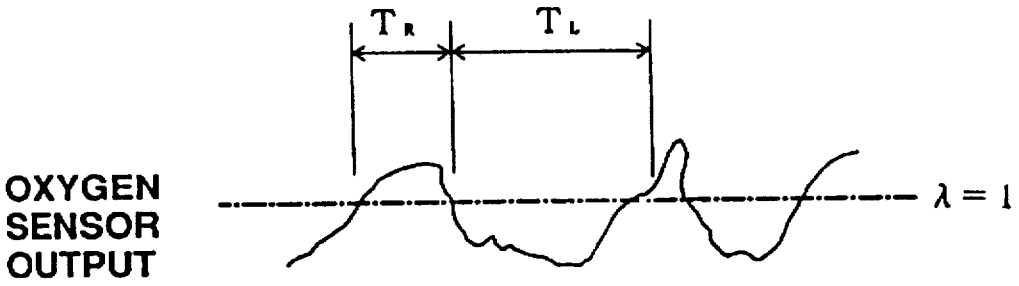
FIG. 7 is a time chart illustrating aspects of measuring rich and lean time intervals.

In step 6, the rich time interval TR and the lean time interval TL occurring during air-fuel ratio feedback control are respectively measured (refer to FIG. 7).

Then in step 7, a ratio $T_{A/F}$ ($T_{A/F}$=TR/TL) of the rich time interval $T_R$ to the lean time interval $T_L$ is computed. In computing the ratio $T_{A/F}$, preferably the average values of the rich time interval $T_R$ and the lean time interval $T_L$ are used, or an average value of a plurality of ratios $T_{A/F}$ is set as a final value.

In step 8, it is judged if the ratio $T_{A/F}$ is less than or equal to 1.1 and greater than or equal to 0.9. If so, then the rich time interval TR and the lean time interval TL are approximately equal, and hence on average, control has been made to the target air-fuel ratio. The routine is thus terminated as is.

On the other hand, if the ratio $T_{A/F}$ exceeds 1.1, that is to say, the rich time interval is relatively long, then the air-fuel ratio control point has deviated to the rich side from the target air-fuel ratio. Hence in this case control proceeds to step 9 (FIG. 4) to correct the rich side deviation.

In step 9, a period TA for the rich lean inversion of the oxygen sensor 16 is measured.

Then in step 10, in order to correct the rich side deviation of the control point to the lean side, then the proportional portion $P_L$ used in reduction control of the correction coefficient α during the lean→rich inversion is increasingly corrected, or the proportional portion $I_L$ used in reduction control of the correction coefficient α during rich conditions is increasingly corrected, or a period for delaying the timing of the increase correction of the correction coefficient α using the proportional portion $P_R$, relative to the rich→lean inversion is increased. Moreover correction of the rich side deviation of the control point to the lean direction can be achieved by executing two or more of these processes in combination. The accuracy of controlling to the target air-fuel ratio can thus be maintained using this lean direction correction by correcting the rich side deviation of the control point due to the inactive condition of the oxygen sensor 16.

In step 11 a difference ΔTA (ΔTA=To−TA) between a reference period To set in accordance with the engine operating conditions, and the beforementioned control period TA is computed.

Then in step 12, it is judged if the difference ΔTA is approximately zero. When the reference period To and the actual control period TA are approximately equal so that the difference ΔTA is approximately zero, then the routine is terminated as is.

On the other hand, in step 12, when judged that the difference ΔTA shows a positive value equal to or greater than a predetermined value, then the actual control period TA is shorter than the reference period To. Hence in this case, in order to make the control period TA approach the reference period To, control proceeds to step 13 the integral portions $I_L$ and $I_R$ used in the integral control of the correction coefficient α are respectively multiplied by 0.9. The multiplied result then becomes the integral portion used in the next integral control, thereby extending the control period TA, to thus suppress oscillations in the air-fuel ratio.

Moreover, in step 12 when judged that the difference ΔTA shows a negative value equal to or greater than a predetermined value, then the actual control period TA is longer than the reference period To. Hence in this case in order to make the control period TA approach the reference period To, control proceeds to step 14 where the integral portions $I_L$ and $I_R$ used in the integral control of the correction coefficient α are respectively multiplied by 1.1. The multiplied result then becomes the integral portion used in the next integral control, thereby shortening the control period TA, and maintaining the required response.

Returning now to step 8, when judged that the ratio $T_{A/F}$ has dropped to below 0.9, that is to say when the rich time interval is relatively short, then the air-fuel ratio control point has deviated to the lean side. Hence in this case control proceeds directly on to step 15 (FIG. 5) and thereafter to correct the lean side deviation.

The process from step 15 through step 20 is carried out in the same manner as the process from step 9 through step 14, except that the correction direction in step 16 is carried out so that the control point deviates to the rich side.

That is to say, in step 16, in order to correct the lean side deviation of the control point, to the rich side, then the proportional portion $P_R$ used in increase control of the correction coefficient α during the rich→lean inversion is increasingly corrected, or the proportional portion $I_R$ used in increase control of the correction coefficient α during lean conditions is increasingly corrected, or a period for delaying the timing of the reduction correction of the correction coefficient α using the proportional portion $P_L$, relative to the lean→rich inversion is increased. Moreover correction of the lean side deviation of the control point to the rich direction can be achieved by executing two or more of these processes in combination. The accuracy of controlling to the target air-fuel ratio can thus be maintained using this rich direction correction by correcting the lean side deviation of the control point due to the inactive condition of the oxygen sensor 16.

I claim:

1. An apparatus for controlling an air-fuel ratio of an internal combustion engine, said apparatus comprising:

an air-fuel ratio sensor provided in an engine exhaust passage, being responsive to the concentration of specific constituents of the exhaust gas which change with an air-fuel ratio of the engine intake mixture, thus causing a change in the output value;

air-fuel ratio feedback control means for feedback controlling a fuel supply quantity to the engine so that the air-fuel ratio of the engine intake mixture approaches a target air-fuel ratio, based on an output value from said air-fuel ratio sensor;

inactive condition detection means for detecting an inactive condition of said air-fuel ratio sensor;

air-fuel ratio deviation detection means for detecting deviation from the target air-fuel ratio of an air-fuel ratio control point in said air-fuel ratio feedback control means, when the inactive condition of said air-fuel ratio sensor is detected by said inactive condition detection means; and control characteristics correction means for correcting the characteristics of said air-fuel ratio feedback control means in a direction to reduce the deviation of the air-fuel ratio control point detected by said air-fuel ratio deviation detection means.

2. An apparatus for controlling an air-fuel ratio of an internal combustion engine according to claim 1, wherein said air-fuel ratio deviation detection means detects the deviation of the air-fuel ratio control point by comparing a rich time interval with a lean time interval during the air-fuel ratio feedback control by said air-fuel ratio feedback control means.

3. An apparatus for controlling an air-fuel ratio of an internal combustion engine according to claim 1, wherein said inactive condition detection means detects the inactive condition of said air-fuel ratio sensor based on exhaust gas temperature.

4. An apparatus for controlling an air-fuel ratio of an internal combustion engine according to claim 1, wherein said inactive condition detection means detects the inactive condition of said air-fuel ratio sensor based on engine load and engine rotational speed.

5. An apparatus for controlling an air-fuel ratio of an internal combustion engine according to claim 1, wherein said inactive condition detection means judges the inactive condition of said air-fuel ratio sensor when engine cooling water temperature, engine rotational speed, engine load, intake air temperature, and exhaust gas temperature are respectively equal to or less than predetermined values.

6. An apparatus for controlling an air-fuel ratio of an internal combustion engine according to claim 1, wherein said air-fuel ratio feedback control means sets an air-fuel ratio feedback correction coefficient for correcting the fuel supply quantity to the engine, based on an output value from said air-fuel ratio sensor, and said control characteristics correction means reduces the deviation of the air-fuel ratio control point by correcting an operating quantity for said air-fuel ratio feedback correction coefficient.

7. An apparatus for controlling an air-fuel ratio of an internal combustion engine according to claim 1, wherein said air-fuel ratio feedback control means proportional-plus-integral controls an air-fuel ratio feedback correction coefficient for correcting the fuel supply quantity to the engine, based on an output value from said air-fuel ratio sensor, and said control characteristics correction means reduces the deviation of the air-fuel ratio control point by correcting a delay time for said proportional control.

8. An apparatus for controlling an air-fuel ratio of an internal combustion engine according to claim 1, further comprising:

control period detection means for detecting an air-fuel ratio control period in said air-fuel ratio feedback control means, when the inactive condition of said air-fuel ratio sensor is detected by said inactive condition detection means; and control period correction means for correcting the characteristics of said air-fuel ratio feedback control means in a direction so that the control period detected by said control period detection means approaches a reference period.

9. An apparatus for controlling an air-fuel ratio of an internal combustion engine according to claim 8, wherein said air-fuel ratio feedback control means proportional-plus-integral controls an air-fuel ratio feedback correction coefficient for correcting the fuel supply quantity to the engine, based on an output value from said air-fuel ratio sensor, and said control period correction means corrects the control period by correcting the integral portion in said integral control.

10. An apparatus for controlling an air-fuel ratio of an internal combustion engine according to claim 1, wherein said air-fuel ratio sensor is one which generates an electromotive force proportional to the ratio of the oxygen concentration in the atmosphere to the oxygen concentration in the exhaust gas.

11. A method of controlling an air-fuel ratio of an internal combustion engine wherein an air-fuel ratio sensor is provided in an engine exhaust passage, said sensor being responsive to the concentration of specific constituents of the exhaust gas which change with an air-fuel ratio of the engine intake mixture, thus causing a change in the output value, said method including: feedback controlling a fuel supply quantity to the engine so that the air-fuel ratio of the engine intake mixture approaches a target air-fuel ratio, based on an output value from said air-fuel ratio sensor; detecting an inactive condition of said air-fuel ratio sensor; detecting a deviation from the target air-fuel ratio of an air-fuel ratio control point in said air-fuel ratio feedback control under said inactive condition; and correcting the characteristics of said air-fuel ratio feedback control in a direction so as to reduce the deviation of said air-fuel ratio control point.

12. A method of controlling an air-fuel ratio of an internal combustion engine according to claim 11, wherein the deviation of the air-fuel ratio control point is detected by comparing a rich time interval with a lean time interval during said air-fuel ratio feedback control.

13. A method of controlling an air-fuel ratio of an internal combustion engine according to claim 11, wherein the inactive condition of said air-fuel ratio sensor is detected based on exhaust gas temperature.

14. A method of controlling an air-fuel ratio of an internal combustion engine according to claim 11, wherein the inactive condition of said air-fuel ratio sensor is detected based on engine load and engine rotational speed.

15. A method of controlling an air-fuel ratio of an internal combustion engine according to claim 11, wherein the inactive condition of said air-fuel ratio sensor is judged when; engine cooling water temperature, engine rotational speed, engine load, intake air temperature, and exhaust gas temperature are respectively equal to or less than predetermined values.

16. A method of controlling an air-fuel ratio of an internal combustion engine according to claim 11, wherein an air-fuel ratio feedback correction coefficient for correcting the fuel supply quantity to the engine is set based on an output value from said air-fuel ratio sensor, and the deviation of the air-fuel ratio control point is reduced by correcting an operating quantity for said air-fuel ratio feedback correction coefficient.

17. A method of controlling an air-fuel ratio of an internal combustion engine according to claim 11, wherein an air-fuel ratio feedback correction coefficient for correcting the fuel supply quantity to the engine is proportional-plus-integral controlled based on an output value from said air-fuel ratio sensor, and the deviation of the air-fuel ratio control point is reduced by correcting a delay time for said proportional control.

18. A method of controlling an air-fuel ratio of an internal combustion engine according to claim 11, wherein as well as correcting the characteristics of said air-fuel ratio feedback control in a direction so as to reduce the deviation of said air-fuel ratio control point, a control period of the air-fuel ratio feedback control during the inactive condition of said air-fuel ratio sensor is detected, and the characteristics of said air-fuel ratio feedback control corrected in a direction so that said detected control period approaches a reference period.

19. A method of controlling an air-fuel ratio of an internal combustion engine according to claim 18, wherein an air-fuel ratio feedback correction coefficient for correcting the fuel supply quantity to the engine is proportional-plus-integral controlled based on an output value from said air-fuel ratio sensor, and the control period is corrected by correcting the integral portion in said integral control.

20. A method of controlling an air-fuel ratio of an internal combustion engine, according to claim 11, wherein said air-fuel ratio sensor is one which generates an electromotive force proportional to the ratio of the oxygen concentration in the atmosphere to the oxygen concentration in the exhaust gas.

* * * * *